US006427706B1

(12) United States Patent
Wissmann et al.

(10) Patent No.: US 6,427,706 B1
(45) Date of Patent: Aug. 6, 2002

(54) SYSTEM FOR CONTINUOUS TREATMENT OF STEEL STRIP

(75) Inventors: Walter Wissmann; Hans Krapinger, both of Vienna (AT)

(73) Assignee: Andritz-Patentverwaltungs-Gesellschaft m.b.H., Graz (AT)

( * ) Notice: Subject to any disclaimer, the term of this patent is extended or adjusted under 35 U.S.C. 154(b) by 0 days.

(21) Appl. No.: 09/516,589

(22) Filed: Mar. 1, 2000

(30) Foreign Application Priority Data

Mar. 5, 1999 (AT) ..... 376/99

(51) Int. Cl.[7] ..... B08B 3/04

(52) U.S. Cl. ..... 134/64 R; 134/122 R; 266/112

(58) Field of Search ..... 134/64 R, 122 R, 134/104.1; 266/111, 112, 113, 114, 120; 277/53, 56

(56) References Cited

U.S. PATENT DOCUMENTS 3,583,411 A * 6/1971 Stricker
4,270,317 A * 6/1981 Kurie
4,807,563 A * 2/1989 Cipriano et al.
4,901,744 A * 2/1990 Hansen
4,928,717 A * 5/1990 Osarek et al.
4,986,291 A * 1/1991 Hula et al.
5,060,683 A * 10/1991 Seiz et al.
5,179,967 A * 1/1993 Mattiussi
5,248,372 A * 9/1993 McNamee
5,282,485 A * 2/1994 Hirai et al.
5,566,694 A * 10/1996 Pugh et al.
5,716,455 A * 2/1998 Zednicek et al.
5,853,495 A * 12/1998 Gravert et al.
6,206,979 B1 * 3/2001 Hiden et al.
6,250,314 B1 * 6/2001 Wasserbauer et al.
6,260,563 B1 * 7/2001 Lordo et al.

FOREIGN PATENT DOCUMENTS

JP 2-133589 * 5/1990

OTHER PUBLICATIONS

European Patent Office 369,984 May 1990.*

* cited by examiner

*Primary Examiner*—Frankie L. Stinson
(74) *Attorney, Agent, or Firm*—Roylance, Abrams, Berdo & Goodman, L.L.P.

(57) ABSTRACT

A pickling tank for the continuous treatment of a steel strip includes a pickling trough and a recovery tank separated from one another by a linkage that allows for limited movement between the trough and recovery tank. The recovery tank includes a pair of press rollers to remove pickling solution from the steel strip. The linkage includes a chute extending from the trough to the recovery tank to contain the pickling solution while allowing for differences between thermal expansion between the pickling trough and recovery tank. In one embodiment, the chute is coupled to the pickling trough and has a free end inserted into the recovery tank. In a second embodiment, the chute includes two telescoping members extending between the trough and recovery tank.

42 Claims, 2 Drawing Sheets

SYSTEM FOR CONTINUOUS TREATMENT OF STEEL STRIP

FIELD OF THE INVENTION

The present invention is directed to a system for the continuous treatment of a steel strip in a liquid treating tank. More particularly, the invention is directed to an apparatus for the continuous pickling of a steel strip.

BACKGROUND OF THE INVENTION

Numerous pickling tanks have been developed for pickling sheet steel in a continuous process. Many of these pickling tanks include a shallow pickling bath where the continuous steel strip is pulled through the bath of pickling acid. Spray nozzles are also used to supply a continuous stream of pickling acid to the steel strip.

Many pickling processes use a plurality of pickling tanks arranged in series. The continuous steel strip is carried through each tank in successive stages to attain the desired pickling effect. The pickling tanks typically include a suitable device for removing excess pickling acid from the steel strip as the steel strip is removed from each successive bath. For example, pressing rollers are often used at each end of a pickling tank to guide the steel strip through the pickling acid and remove the excess pickling acid from the strip. An example of this type of pickling tank is disclosed in U.S. Pat. No. 5,800,694 to Starcevic et al.

Another example of a pickling tank is disclosed in U.S. Pat. No. 5,566,694 to Pugh et al. The pickling tank includes two end stands spaced apart from each other and secured to a foundation. A trough containing a pickling acid extends between the two stands and is anchored at the center. The stands at each end of the trough include pressing rollers to guide the steel strip. An expandable seal connects each end of the trough with each stand to allow for thermal expansion of the trough relative to the stands. The expandable seal is formed from several spaced apart baffles allowing some movement between the trough and the stand.

Recently, there has been an increase in interest in producing pickling tanks made of a synthetic material that are resistant to attack by the pickling acids. However, tanks made from synthetic materials often are not sufficiently strong to contain the weight of the pickling bath and the steel strip. As a result, the pickling tanks can sag and deform due to the weight of the pickling acid and the temperature of the acid bath. In addition, the end chambers of the bath when made from a synthetic material often deform causing leaking of the pickling acid. It is very difficult to control the flow of the pickling acid in these devices because the liquid level in the pickling bath is above the seal between the pickling tank and the end chamber.

SUMMARY OF THE INVENTION

The present invention is directed to a pickling tank for treating a continuous steel strip. More particularly, the invention is directed to a pickling tank assembly having an expandable linkage to prevent leaking of pickling acid.

Accordingly, a primary object of the invention is to provide a pickling tank having a sealing assembly for containing the pickling acid.

Another object of the invention is to provide a pickling tank having a sealing assembly at each end where the liquid level in the pickling tank is independent of the sealing assembly.

A further object of the invention is to provide a pickling tank for a steel strip where the liquid level in the pickling tank can be adjusted independent of the sealing assembly.

Another object of the invention is to provide a pickling tank having a pickling trough and a separate pickling acid recovery tank spaced from the pickling trough.

Still another object of the invention is to provide a pickling tank having a pickling trough and a pickling acid recovery tank where the recovery tank includes two opposing pressing rollers for removing pickling acid from a steel strip.

A further object of the invention is to provide a pickling tank having a pickling trough and a separate pickling acid recovery tank where a primary acid recirculating loop takes place only in the pickling trough.

A further object of the invention is to provide a pickling tank having a pickling trough and a pickling acid recovery tank having two opposing pressing rollers and a chute connecting the pickling trough with the recovery tank where the chute allows limited movement between the pickling trough and the recovery tank.

Another object of the invention is to provide a pickling tank including a pickling trough and a pickling acid recovery tank coupled together by a chute that is able to accommodate for thermal expansion between the pickling trough and the recovery tank.

A further object of the invention is to provide a pickling tank made of a synthetic material that is resistant to corrosion attack by a pickling acid.

Another object of the invention is to provide a pickling tank having an overflow tray made of a synthetic material, a pickling trough and a pickling acid recovery tank where the pickling trough is positioned on the tray.

A further object of the invention is to provide a pickling tank having a pickling trough, a pickling acid recovery tank having two opposing pressing rollers and a chute having a first end connected to the pickling tank and a second end forming a seal against the rollers.

The objects of the invention are basically attained by providing a pickling tank for pickling a continuous strip. The pickling tank comprises a pickling trough for containing a pickling solution. The pickling trough has a bottom wall, a first end wall at a first end of the trough and a second end wall at a second end of the trough. The first end wall has an inlet for the continuous strip and the second end wall has an outlet for the continuous strip. A pickling solution recovery tank has an inlet, an outlet and two opposing pressing rollers positioned in the recovery tank. The recovery tank is spaced from and coupled to the pickling trough.

The objects of the invention are further attained by providing a pickling tank for pickling a continuous steel strip. The pickling tank comprises a pickling trough having a pickling bath area with a first end and a second end. The pickling trough is dimensioned for containing a pickling solution. The pickling trough has a pickling solution discharge trough at the first end of the pickling trough for receiving overflow pickling solution from the pickling bath area. A pickling solution recovery tank has two opposing pressing rollers positioned in the recovery tank for removing pickling solution from a steel strip passing through the tank. A chute has a first end coupled to the discharge trough and a second end coupled to the recovery tank. The chute is coupled to the discharge trough and the recovery tank to allow limited movement between the discharge trough and recovery tank.

The objects, advantages and salient features of the invention will become apparent to one skilled in the art in view of the following detailed description of the invention, taken in conjunction with the annexed drawings which form a part of this original disclosure.

BRIEF DESCRIPTION OF THE DRAWINGS

The following is a brief description of the drawings in which.

DETAILED DESCRIPTION OF THE INVENTION

Figure 1:
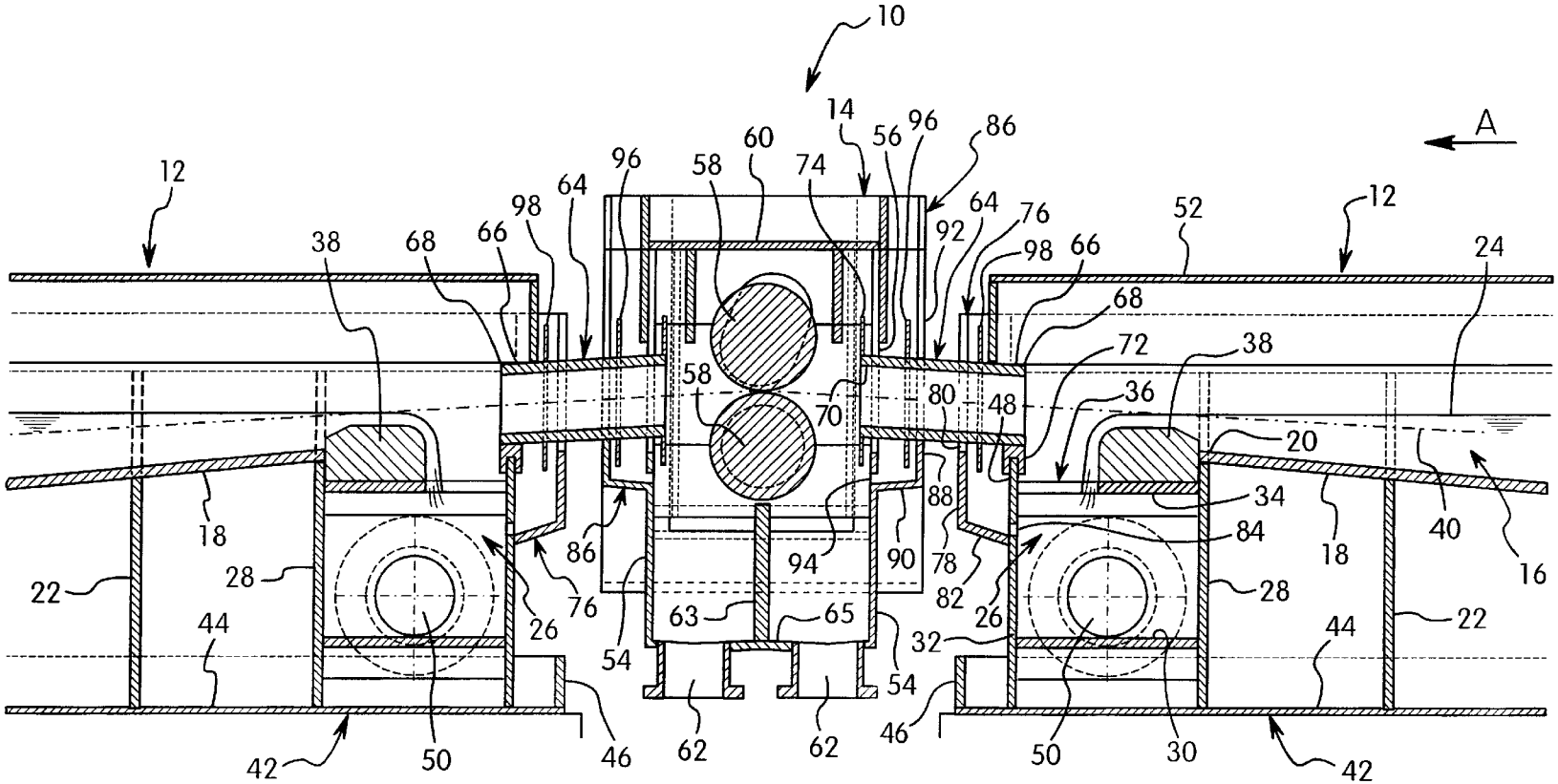
FIG. 1 is a partial side elevational view in cross section showing the ends of pickling tanks and a pickling solution recovery tank connected together by a chute.

The present invention is directed to a pickling tank assembly 10 for treating a continuous strip of steel 40. The pickling tank assembly 10 of the invention includes a pickling trough 12 and a pickling solution recovery tank 14.

The pickling tank assembly 10 of the invention provides a connection between various components of the assembly for containing the pickling solution while allowing thermal expansion between the various components. The pickling apparatus 10 typically includes several pickling troughs 12 connected together in series for guiding a steel strip 40 through several pickling acid baths. In the embodiments illustrated, two pickling troughs 12 are illustrated. It will be appreciated that the number of pickling troughs can vary depending on the needs of the pickling process.

In the embodiment illustrated, two pickling troughs 12 are provided and connected to a single recovery tank 14. In practice, a recovery tank 14 is positioned at the upstream end of pickling trough 12 for feeding the steel strip through pickling trough 12. Similarly, a recovery tank 14 is position downstream at a discharge end of each pickling trough 12. Several pickling troughs can be connected in series and separated by a recovery tank 14. In a preferred embodiment, each pickling trough is substantially identical.

Referring to FIG. 1, pickling trough 12 includes a pickling bath area 16 on a bottom wall 18. Bottom wall 18 has a generally V-shaped configuration to provide a sufficient depth to the pickling solution as known in the art. Bottom wall 18 has an end 20 defining the end of the bath area 16. Several legs 22 are coupled to bottom wall 18 to support trough 12. Pickling trough 12 includes inlets (not shown) for introducing and recirculating a pickling solution as in conventional pickling tanks. The end portion 20 of bottom wall 18 contains the pickling solution at a predetermined level 24 in bath area 16 as shown in FIG. 1.

A discharge trough 26 is provided at each end of pickling trough 12 and at the end of the bath area 16. Pickling trough 26 includes an inner wall 28, a bottom wall 30 and an outer end wall 32. Inner wall 28 in the embodiment shown extends substantially vertically and is coupled to the end 20 of bottom wall 18. Inner wall 28 extends substantially parallel to supporting legs 22 and assists in supporting trough 12. Outer end wall 32 is spaced from inner wall 28 and extends substantially parallel thereto for forming an end wall of pickling trough 12. Discharge trough 26 includes a top wall 34 coupled to inner wall 28. Top wall 34 is spaced from outer end wall 32 to form an opening 36 into discharge trough 26. In this embodiment, trough 26 prevents large quantities of pickling solution from entering recovery tank 14.

A guide member 38 is positioned on top wall 34 to guide the steel strip 40 being carried through the pickling trough. Guide member 38 preferably extends the entire width of pickling trough 12 and has a height sufficient to support and guide steel strip 40 and prevent steel strip 40 from contacting inner wall 28 and end 20 of bottom wall 18. Preferably, guide member 38 has a height to support steel strip above end 20 of bottom wall 18. As shown in FIG. 1, guide member 38 also has a height sufficient to form a dam and assist in controlling the level and depth of the pickling solution in pickling trough 12. Preferably, guide member 38 is removable and can be replaced with a different guide member having a different height as needed for adjusting the level of the pickling solution.

In preferred embodiments, pickling trough 12 is made from a light weight, synthetic material that is non-reactive and resistant to corrosion attack by the pickling solution. Examples of suitable synthetic materials include polypropylene, polyethylene and polyvinyl chloride. The pickling solution is typically sulfuric acid, nitric acid, hydrochloric acid, hydrofluoric acid, and mixtures thereof as known in the art.

In the embodiment illustrated, pickling trough 12 is positioned in an overflow tray 42 having a dimension to contain pickling trough 12. Tray 42 is preferably made of a synthetic material such as polypropylene and is dimensioned to contain pickling solution that may spill or leak from pickling trough 12. As shown in FIG. 1, tray 42 has a substantially flat bottom wall 44 and side walls 46. Support legs 22 of pickling trough 12 preferably rest directly on bottom wall 44 of tray 42. Tray 42 can also include an outlet (not shown) for recovering and recycling pickling solution. In one embodiment of the invention, pickling trough 12 is fixed to tray 42 and centrally located therein.

A steel strip 40 is passed through pickling trough 12 in the direction of arrow A, through the pickling solution 24, and through an outlet 48 in outer end wall 32. The pickling solution is drawn along the bath area 16 in the direction of outlet 48 by the movement of the steel strip and overflows into discharge trough 26. The pickling solution exits discharge trough 26 through an outlet pipe 50 where the pickling solution is regenerated and recycled to the bath area 16. Preferably, a cover 52 is attached to pickling trough 12 to contain acid vapors. The pickling solution in pickling trough 12 is recirculated and replenished according to standard procedures in the pickling industry.

Recovery tank 14 is a separate structure from pickling trough 12 and is spaced from outlet 48 in end wall 32. Recovery tank 14 includes side walls 54 having an opening 56 in each wall. As shown in FIG. 1, recovery tank 14 is symmetrical so that each side is a mirror image of the other. Two opposing pressing rollers 58 are mounted in recovery tank 14 for guiding steel strip 40 and removing pickling solution from the steel strip passing through recovery tank 14. A top wall 60 is coupled to side walls 54 and encloses recovery tank 14. Recovery tank 14 also includes two discharge outlets 62 at a bottom end thereof for recovering pickling solution. Typically, the pickling solution recovered from recovery tank 14 is not recirculated to pickling trough 12. As shown in FIG. 1, steel strip 40 passes through pickling trough 12 and is guided through a first opening 56 in recovery tank 14 and between rollers 58. Steel strip continues and is discharged through the opposite opening 56 on an opposite side wall 54 and directed to a second pickling trough. The second pickling trough is substantially identical to pickling trough 12 so that identical components are identified by the same reference number.

Recovery tank 14 is connected to pickling trough 12 by a suitable linkage 64 as shown in FIG. 1. Linkage 64 forms a connection to contain pickling solution in the respective pickling trough while allowing for relative movement between the pickling trough and the recovery tank. Linkage 64 in a preferred embodiment is a chute 66 forming an enclosed path extending from pickling trough 12 to recovery tank 14. Chute 66 provides a connection between pickling trough 12 and recovery tank 14 to contain the pickling solution and compensates for movement between pickling tank 12 and recovery tank 14 due to thermal expansion from changes in temperature.

In the embodiment of FIG. 1, chute 66 includes a first end 68, coupled to outer end wall 32 of pickling trough 12 and a second end 70 positioned in recovery tank 14. First end 68 of chute 66 includes a flange 72 that is preferably fixed to outer end wall 32. Second end 70 extends through opening 56 in side wall 54 of recovery tank 14 and is able to float freely with respect to side wall 54. Preferably, second end 70 of chute 66 includes a radially extending flange 74 having a dimension greater than opening 56 to prevent pickling solution from splashing outwardly through opening 56. An identical chute 66 connects recovery tank 14 with the downstream trough 12.

In preferred embodiments, chute 66 is positioned at an incline with the second end 70 higher than first end 68. Positioning chute 66 at an incline enables pickling solution draining from steel strip 40 to drain back into pickling trough 12 instead of flowing toward recovery tank 14. Therefore, only small amounts of pickling solution are carried into recovery tank 14.

As shown in FIG. 1, end wall 32 includes an overflow trough 76 adjacent outlet 48. Overflow trough 76 includes an end wall 78 spaced from outer end wall 32 of trough 12 and includes a substantially U-shaped recess 80 to accommodate chute 66. A bottom wall 82 is coupled to end wall 78 and inclined toward outer end wall 32. A drain opening 84 is provided in outer end wall 32 adjacent bottom wall 82 of overflow trough 76 to allow pickling solution to drain into discharge trough 26. In this manner, pickling solution that may pass between chute 66 and outlet 48 is collected in overflow trough 76 and recycled to the pickling trough 12.

Recovery tank 14 includes a similar overflow trough 86 coupled to each side wall 54 at openings 56. Overflow trough 86 includes an end wall 88 extending parallel to side wall 54 and a bottom wall 90 inclined toward side wall 54. A recess 92 is dimensioned to receive chute 66. A drain opening 94 is formed inside walls 54 to drain pickling solution into recovery tank 14. An annular shield 96 extending radially outward from chute 66 is provided in overflow trough 86 to prevent pickling solution from passing through recess 92. A similar shield 98 is coupled to chute 66 and positioned in overflow trough 76.

As shown in FIG. 1, a vertical dividing plate 63 is positioned below press rollers 58 and extends to a bottom wall 65 of recovery tank 14. Dividing plate 63 and press rollers 58 separate recovery tank 14 symmetrically into an upstream side and a downstream side and directs recovered pickling solution to an outlet 62 on either the upstream side or downstream side. In this manner, pickling solution from the upstream side can be isolated from the pickling solution from the downstream side.

In operation, several pickling troughs are assembled in series with a recovery tank positioned between the troughs. A continuous steel strip is passed through guide rollers into the pickling trough and passes through the pickling solution. The steel strip then passes through the chute to the recovery tank where the pressing rollers remove any remaining pickling solution. The steel strip continues through a chute at the outlet end of the recovery tank to the next pickling trough.

Figure 2:
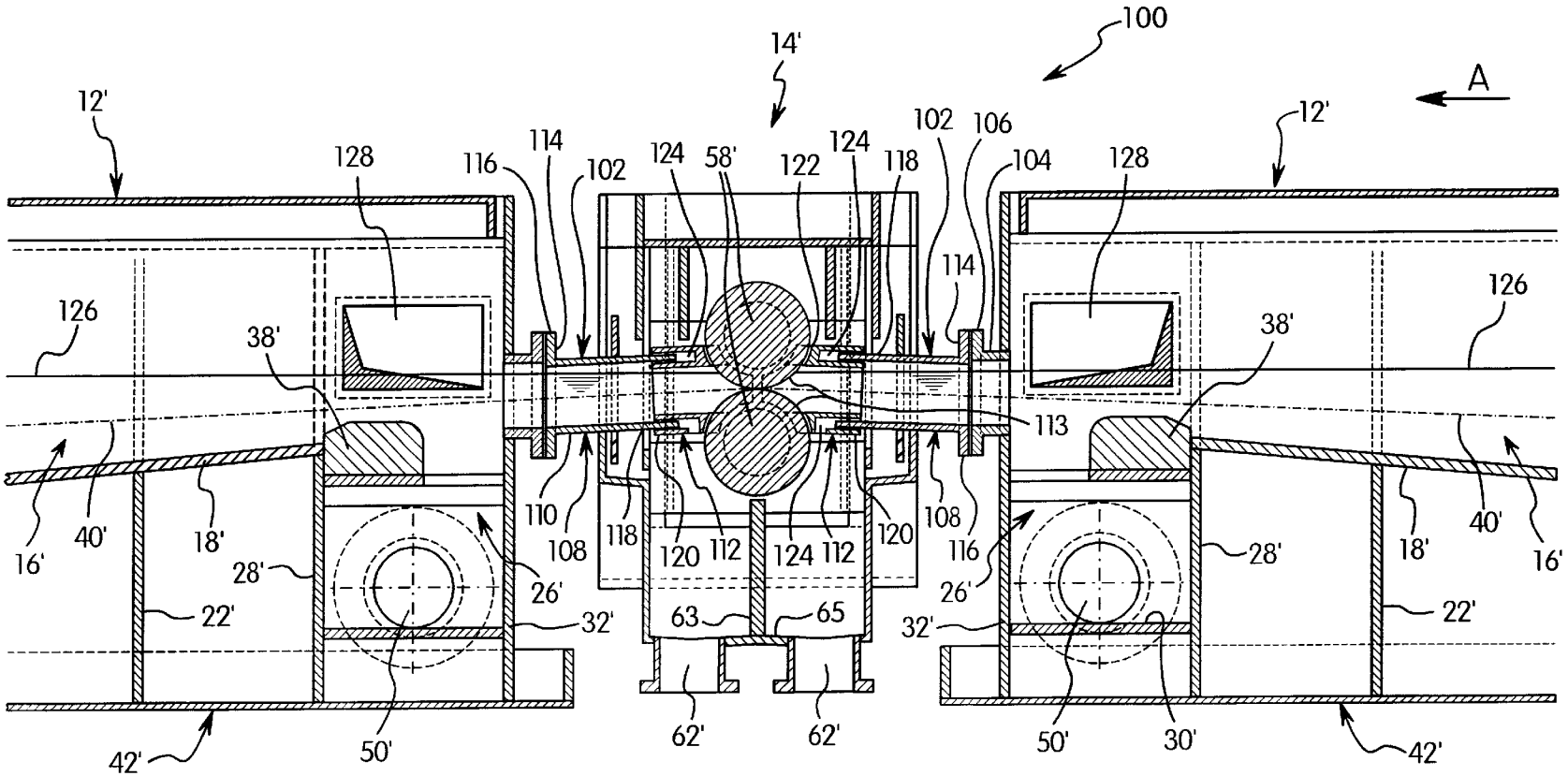
FIG. 2 is a side elevational view in cross section showing a second embodiment of the invention including two pickling troughs and a pickling solution recovery tank connected together by an expandable chute.

Referring to FIG. 2, a pickling tank assembly 100 in a second embodiment of the invention is illustrated. Pickling tank assembly 100 includes pickling troughs 12' and a recovery tank 14'. Pickling trough 12' and recovery tank 14' are similar to the embodiment of FIG. 1 so that identical components are identified by the same reference number with the addition of a prime. Pickling tank 100 differs from the embodiment of FIG. 1 by the linkage 102 connecting trough 12' with recovery tank 14'.

Pickling tank assembly 100 uses press rollers 58' as dam rollers to increase the depth of the pickling solution and the length of the bath area 16'. Pickling tank assembly 100 is particularly suitable for high speed pickling processes that are able to treat a steel strip above 150 meters per minute.

Linkage 102 in the embodiment of FIG. 2 forms a conduit between trough 12' and recovery tank 14'. A collar 104 is connected to outer wall 32' surrounding outlet 48'. A flange 106 is connected to an outer end of collar 104 and extends radially outward. A chute 108 is coupled to flange 106 and extends through opening 56' into recovery tank 14'. In embodiments of the invention, chute 108 can have a square, rectangular or circular cross-section.

Chute 108 is an expandable member having a first telescoping section 110 and a second telescoping section 112. First section 110 has a first end 114 with a flange 116 for coupling with flange 106. First section 110 has a second end 118 coupled to second section 112.

Second section 112 has a first end 120 coupled to second end 118 of first section 110 and a second end adjacent press rollers 58'. First end 120 of second section 112 includes a slot 124 extending longitudinally through second section 112. Slot 112 is dimensioned to accommodate second end 118 of first section 110. As shown in FIG. 2, second end 118 of first section 110 slides longitudinally within slot 124. Preferably, second end 118 of first section 110 forms a fluid-tight seal in slot 124.

Second end 122 of second section 112 has curved surfaces 113 that are shaped to conform to the contour of press rollers 58'. Preferably, second end 122 forms a liquid seal between chute 108 and press rollers 58'.

In the embodiment of FIG. 2, chute 108 forms fluid-tight connections between trough 12' and press rollers 58' to contain the pickling solution. Press rollers 58 form a dam to contain the pickling solution in chute 108 and in pickling trough 12'. Outlet 50' of discharge trough 26' can be closed partially to increase the depth of the pickling solution to level 126 above guide member 38'. As shown in FIG. 2, the level of the pickling solution 126 is above the bottom portion of chute 108. Thus, the effective length of the pickling bath extends from the press rollers 58' through chute 108 and through the entire length of pickling trough 12'. Pickling trough 12' includes an overflow outlet 128 to maintain a desired level of the pickling solution in pickling trough 12'.

As in the previous embodiment, the steel strip 40' is fed through pickling trough 12' through the bath area 16'. The steel strip 40' exits the outlet end of pickling trough 12' and passes through chute 108 to press rollers 58'. Steel strip 40' passes between rollers 58' and through chute 108 on the opposite side of recovery tank 14' to the next pickling trough 12'. The second section 112 of chute 108 forms a seal box against the rollers 58' to substantially prevent the pickling solution from passing between adjacent pickling troughs. In the embodiment illustrated, chute 108 includes telescoping sections to allow for movement between trough 12' and recovery tank 14' in a longitudinal direction with respect to chute 108. In further embodiments, chute 108 can include two sections connected together by an expandable bellows structure to allow longitudinal movement between the two sections of the chute.

While several embodiments have been chosen to illustrate the invention, it will be appreciated that various modifications can be made without departing from the scope of the invention as defined in the appended claims.

What is claimed is:

1. A pickling tank for pickling a continuous strip, said pickling tank comprising:

a pickling trough for containing a pickling solution, said pickling trough having a bottom wall, a first end wall at a first end of said trough and a second end wall at a second end of said trough, said first end wall having an inlet for said continuous strip and said second end wall having an outlet for said continuous strip;

a pickling solution recovery tank having an inlet, an outlet and two opposing pressing rollers positioned in said recovery tank, said recovery tank being spaced from and coupled to said pickling trough; and a chute having a first end coupled to said pickling tank and a second end extending through said inlet of said recovery tank and being slidable with respect to said inlet of said recovery tank.

2. The pickling tank of claim 1, wherein said first end of said chute is coupled to said first end wall of said pickling tank.

3. The pickling tank of claim 1, wherein said pickling trough comprises a discharge trough at said second end of said pickling trough for recovering overflow pickling solution from said pickling trough, wherein said first end of said chute is coupled to said second end wall of said pickling trough.

4. The pickling tank of claim 1, wherein said first end of said chute includes a flange, wherein said flange is coupled to said pickling trough.

5. The pickling tank of claim 1, wherein said recovery tank includes a side wall and said inlet is formed in said side wall.

6. The pickling tank of claim 5, wherein said second end of said chute includes an outwardly extending flange for shielding said opening and for retaining said second end of said chute in said recovery tank.

7. The pickling tank of claim 1, wherein said chute is expandable for allowing movement between said recovery tank and said pickling trough.

8. The pickling tank of claim 7, wherein said chute includes a first telescoping member and a second telescoping member coupled together to provide a telescoping connection between said pickling trough and said recovery tank.

9. The pickling tank of claim 8, wherein said first telescoping member has a first and second end, said first end of said first telescoping member being coupled to said pickling trough, and said second telescoping member has a first end and a second end, said first end of said second telescoping member being coupled to said second end of said first telescoping member in a sliding relationship and said second end of said telescoping member positioned in said recovery trough.

10. The pickling tank of claim 9, wherein said second end of said second telescoping member is coupled to said recovery tank.

11. The pickling tank of claim 10, wherein said second end of said second telescoping member comprises a sealing surface, said sealing surface cooperating with said pressing rollers for sealing said second end of said chute.

12. The pickling tank of claim 1, wherein said second end of said chute is positioned adjacent said pressing rollers.

13. The pickling tank of claim 1, wherein said pickling trough is made of a synthetic material.

14. The pickling tank of claim 13, wherein said pickling tank is made of polypropylene.

15. The pickling tank of claim 1, further comprising a tray made of a synthetic material, wherein said pickling trough is mounted on said tray.

16. The pickling tank of claim 15, wherein said pickling trough is centrally located in said tray.

17. The pickling tank of claim 1, wherein said pickling trough includes an overflow outlet at one end.

18. A pickling tank for pickling a continuous steel strip, said pickling tank comprising:

a pickling trough having a pickling bath area with a first end and a second end, said pickling trough being dimensioned for containing a pickling solution, said pickling trough having a pickling solution discharge trough at said first end of said pickling trough for receiving overflow pickling solution from said pickling bath area;

a pickling solution recovery tank having two opposing pressing rollers positioned in said recovery tank for removing pickling solution from a steel strip passing through said tank; and a chute having a first end coupled to said discharge trough and a second end coupled to said recovery tank, said chute being coupled to said discharge trough and said recovery tank to allow limited movement between said discharge trough and recovery tank.

19. The pickling tank of claim 18, wherein said first end of said chute is spaced from said first end of said pickling bath area.

20. The pickling tank of claim 18, wherein said first end of said chute includes a flange, and said flange being coupled to said pickling trough.

21. The pickling tank of claim 18, wherein said recovery tank includes a side wall having an inlet opening, and wherein said second end of said chute extends through said inlet opening and is slidable with respect to said side wall of said recovery tank.

22. The pickling tank of claim 21, wherein said second end of said chute includes an outwardly extending flange for shielding said inlet opening and retaining said second end of said chute in said recovery tank.

23. The pickling tank of claim 18, wherein said chute is expandable for allowing movement between said recovery tank and said pickling trough.

24. The pickling tank of claim 18, wherein said chute includes a first telescoping member and a second telescoping member coupled together to provide a telescoping connection between said pickling trough and said recovery tank.

25. The pickling tank of claim 24, wherein said first telescoping member has a first end and a second end, said first end being coupled to said pickling trough, and said second telescoping member has a first end and a second end, said first end coupled to said second end of said first telescoping member in a sliding relationship and said second end being positioned in said recovery trough.

26. The pickling tank of claim 25, wherein said second end of said second telescoping member is coupled to said recovery tank.

27. The pickling tank of claim 26, wherein said second end of said second telescoping member comprises a sealing surface, said sealing surface cooperating with said pressing rollers for sealing said second end of said chute.

28. The pickling tank of claim 18, wherein said second end of said chute is positioned adjacent said pressing rollers.

29. The pickling tank of claim 18, wherein said pickling trough is made of a synthetic material.

30. The pickling tank of claim 29, wherein said pickling tank is made of polypropylene.

31. The pickling tank of claim 18, further comprising a tray made of a synthetic material, wherein said pickling trough is mounted on said tray.

32. The pickling tank of claim 31, wherein said pickling trough is centrally located in said tray.

33. The pickling tank of claim 18, wherein said pickling trough includes an overflow outlet at one end.

34. The pickling tank of claim 18, further comprising a guiding member for guiding a steel strip from said pickling bath area to said chute.

35. The pickling tank of claim 34, wherein said guiding member is removably coupled to said pickling trough.

36. The pickling tank of claim 18, wherein said pickling trough has an end wall with a first opening for receiving said first end of said chute, said tank comprising an overflow trough coupled to an outer surface of said end wall for recovering pickling solution passing through said first opening from said pickling bath area, said end wall further having a second opening for returning pickling solution from said overflow trough to said pickling trough.

37. The pickling tank of claim 18, wherein said recovery tank has an end wall with a first opening for receiving said second end of said chute, said pickling tank comprising an overflow trough coupled to an outer surface of said end wall for recovering pickling solution passing through said first opening from said pressing rollers, said end wall further having a second opening for returning pickling solution from said overflow trough to said pickling trough.

38. A pickling tank for pickling a continuous strip, said pickling tank comprising:

a pickling trough having a bath area for containing a pickling solution, said pickling trough having a bottom wall, a first end wall at a first end of said trough and a second end wall at a second end of said trough, said first end wall having an inlet for said continuous strip and said second end wall having an outlet for said continuous strip, a discharge trough between said bottom wall and said first end wall for receiving overflow pickling solution from said bath area; and a pickling solution recovery tank having an inlet, an outlet and two opposing pressing rollers positioned in said recovery tank, said recovery tank being spaced from and coupled to said first end wall of said pickling trough to allow expansion of said pickling trough with respect to said recovery tank.

39. The pickling tank of claim 38, further comprising a chute having a first end coupled to said first end wall of said pickling tank and a second end positioned in said recovery tank.

40. The pickling tank of claim 39, wherein said first end of said chute includes a flange, wherein said flange is coupled to said pickling trough.

41. The pickling tank of claim 39, wherein said recovery tank includes a side wall and said inlet is formed in said side wall, and wherein said second end of said chute extends through said inlet and is slidable with respect to said side wall of said recovery tank.

42. The pickling tank of claim 41, wherein said second end of said chute includes an outwardly extending flange for shielding said opening and for retaining said second end of said chute in said recovery tank.

* * * * *